US005828940A

United States Patent [19]

Learman

[11] Patent Number: 5,828,940

[45] **Date of Patent: *Oct. 27, 1998**

[54] FORMABLE COMPOSITE MAGNETIC FLUX CONCENTRATOR AND METHOD OF MAKING THE CONCENTRATOR

[75] Inventor: Thomas J. Learman, Grand Haven, Mich.

[73] Assignee: Learflux Inc., Ferrysburg, Mich.

[ * ] Notice: The term of this patent shall not extend beyond the expiration date of Pat. No. 5,529,747.

[21] Appl. No.: 592,097

[22] Filed: Jan. 26, 1996

Related U.S. Application Data

[60] Division of Ser. No. 351,510, Dec. 7, 1994, Pat. No. 5,529,747, which is a continuation-in-part of Ser. No. 150, 392, Nov. 10, 1993, Pat. No. 5,418,069.

[51] Int. Cl.[6] ..... B22F 3/02

[52] U.S. Cl. ..... 419/10; 419/23

[58] Field of Search ..... 419/38, 10, 23

[56] References Cited

U.S. PATENT DOCUMENTS

| | | | |
|---|---|---|---|
| 3,652,965 | 3/1972 | Krebs et al. | 335/277 |
| 3,798,059 | 3/1974 | Astle et al. | 117/212 |
| 3,917,778 | 11/1975 | Shiraki et al. | 264/63 |
| 4,197,146 | 4/1980 | Frischmann | 148/31.55 |
| 4,255,684 | 3/1981 | Mischler et al. | 310/216 |
| 4,486,641 | 12/1984 | Ruffini | 219/10.79 |
| 4,489,950 | 12/1984 | Chorney | 277/80 |
| 4,631,381 | 12/1986 | Delage et al. | 219/10.57 |
| 4,689,163 | 8/1987 | Yamashita et al. | 252/62.54 |
| 4,776,980 | 10/1988 | Ruffini | 252/513 |
| 4,832,891 | 5/1989 | Kass | 264/101 |

(List continued on next page.)

FOREIGN PATENT DOCUMENTS

| | | |
|---|---|---|
| 0044592 | 7/1981 | European Pat. Off. . |
| 0145178 | 10/1984 | European Pat. Off. . |
| 0255392 | 6/1986 | European Pat. Off. . |
| 0544009A1 | 1/1993 | European Pat. Off. . |
| 94308307 | 11/1995 | European Pat. Off. . |
| 61-179803 | 8/1986 | Japan . |
| WO 8905032 | 6/1989 | WIPO . |

OTHER PUBLICATIONS

Exhibit A is an article entitled "High–Frequency Magnetic Materials", authored by W.J. Polydoroff, copyright 1960, published by John Wiley & Sons, Inc., New York, New York, pp. 1–9, which discloses magnetic materials and properties.

Exhibit B are product brochures entitled "Carpenter–Magnetic Alloys", published by Carpenter Technology, Carpenter Steel Division, Reading, Pennsylvania, including a product brochure on 49 alloy and on silicon iron core material, published Nov., 1988, and Mar., 1989, respectively.

Exhibit C is an article entitled "Production and Concentration of Magnetic Flux for Induction (Eddy Current) Heating Application", authored by Robert S. Ruffini, published in *Industrial Heating Magazine*, Nov. 1994, pp. 41–45, which discloses various concentrator materials and magnetic flux characteristics.

*Primary Examiner*—Daniel J. Jenkins

*Attorney, Agent, or Firm*—Price, Heneveld, Cooper, DeWitt & Litton

[57] ABSTRACT

A formable composite magnetic flux concentrator material is composed of about 65% to 90% ferromagnetic material, such as iron powder, and about 35% to 10% binder, the binder being a mixture of an epoxy and one or more catalysts. The concentrator material is provided in a formable state as a putty-like body which can be worked into any desired shape dictated by the configuration of the induction heating coil used in a particular application. In one form, the density of the concentrator material is increased by application of vibration, compression and vacuum to de-air the material and to reduce voids therein. In another form, the iron powder comprises spherical-shaped particles and non-spherical shaped powders chosen in a ratio to maximize the density of material available.

21 Claims, 2 Drawing Sheets

U.S. PATENT DOCUMENTS

| | | | |
|---|---|---|---|
| 4,833,436 | 5/1989 | Martin et al. | 336/60 |
| 4,920,009 | 4/1990 | Lee et al. | 428/552 |
| 4,999,322 | 3/1991 | Reick | 501/83 |
| 5,088,976 | 2/1992 | Liboff et al. | 600/13 |
| 5,101,086 | 3/1992 | Dion et al. | 219/10.491 |
| 5,112,801 | 5/1992 | Nellis et al. | 505/1 |
| 5,126,611 | 6/1992 | Armstrong et al. | 310/90.5 |
| 5,130,588 | 7/1992 | Armstrong et al. | 310/90.5 |
| 5,196,457 | 3/1993 | Wilkinson et al. | 522/103 |
| 5,211,896 | 5/1993 | Ward et al. | 264/126 |
| 5,418,069 | 5/1995 | Learman | 428/551 |

FORMABLE COMPOSITE MAGNETIC FLUX CONCENTRATOR AND METHOD OF MAKING THE CONCENTRATOR

This application is a division of Ser. No. 08/351,510 filed Dec. 7, 1994 U.S. Pat. No. 5,529,747 which is a continuation-in-part of U.S. patent application Ser. No. 08/150,392, filed Nov. 10, 1993, entitled "FORMABLE COMPOSITE MAGNETIC FLUX CONCENTRATOR AND METHOD OF MAKING THE CONCENTRATOR" (now U.S. Pat. No. 5,418,069, issued May 23, 1995), the inventor of this and the parent application being the same.

BACKGROUND OF THE INVENTION

1. Field of the Invention

The present invention generally relates to induction heating and, more particularly, to a formable composite magnetic flux concentrator for use in induction heating applications or in any application utilizing a high frequency magnetic field. The present invention also relates to a method of making the concentrator.

2. Description of the Prior Art

Induction heating is a relatively efficient manner of generating heat in an electrically conductive part. When changing electrical current flows in an induction heating coil, it will cause a changing magnetic field to be generated about the coil. If the electrically conductive part is placed within the coil, then the changing magnetic field will induce a current to flow around the part which will generate heating of the part due to its inherent electrical resistance to the current flow. No contact is necessary between the coil and part. The magnetic flux field is passed through an air gap between the coil and part.

By placing a composite magnetic flux concentrator on the induction heating coil, a stronger magnetic field is generated in the air gap between the coil and part. The stronger the magnetic field, the faster and more efficiently the part will be heated. The magnetic flux concentrator is formed of a magnetically conductive material that, when placed on the coil, creates a more efficient and controlled magnetic flux path and increases the intensity of the magnetic flux field.

The use of a magnetic flux concentrator also has the following additional benefits. The concentrator (1) increases the magnetic coupling into the part, thus using less energy; (2) decreases the potential hazardous magnetic and RF exposure to which machine operators are exposed; (3) defines the specific area that is to be induction heated, thereby holding the heat affected zone to a controlled or minimum which is metallurgically beneficial to the part; and (4) allows the focusing/shielding of the magnetic energy into/from zones that would not otherwise be achievable without the use of the concentrator.

There are basically three different types of prior art magnetic flux concentrators in commercial use. The first type of prior art concentrator is provided in the form of laminations of numerous thin sheets of steel. Each sheet is electrically insulated from the other sheets. The laminations are custom fitted to the shape required and placed side by side over the coil. However, undesirably high eddy currents are generated within the sheets and excess heat energy is produced within the concentrator. At higher frequencies, thinner laminations must be used in order to keep eddy current generation to a minimum. Because of physical thickness limitations, this first type of concentrator is limited to relatively low frequency applications. Also, excess heat production requires cooling of the laminations which is labor intensive and expensive. Thus, the problems associated with the laminated type of concentrator is the amount of labor required for custom fabrication, the expense and difficulty in cooling, the difficulty in repairing laminations, and the limitation of use to relatively low frequencies.

The second type of prior art concentrator is a ferrite. The ferrite is an iron alloy crystal that is pressed into a form that has in itself been custom fitted to the coil. The formed substance is then fired at very high temperature in an oxygen free oven to form a ceramic-like material. Being of a ceramic-like material, the concentrator will fracture if heating is not uniform. When a part is heated it increases in heat energy and, in turn, radiates heat energy into the work coil and the concentrator. The radiant heating oftentimes causes uneven heating of the material. Being a hard, stone-like material, the ceramic-like concentrator is all but impossible to water cool, without generating thermal stresses.

The third type of prior art concentrator is a machinable bar made by combining very small insulated iron powdered metal particles and small amounts of binder. This combination is then placed in a mold and pressed with a force of over 30 to 50 tons per square inch while heat is applied. Once formed the bar must be machined to fit the coil shape needed. This type of concentrator is able to work at higher frequencies than the laminated material because of the insulating abilities and low hysteresis losses of the small powders. However, when large magnetic fluxes are applied for long periods of time, the need to water cool the concentrator still exists. The bar concentrator is expensive to form, labor intensive to machine, and difficult to water cool.

In the above noted third type of concentrator, it is desirable to have iron particles that are very pure, internally unstressed, and electrically insulated from one another. A reason is because the purity and internally unstressed condition of the iron particles allows the iron to change magnetic polarity efficiently without generation of heat and with minimal hysteresis losses. Electrically insulating the particles, such as by covering them with phosphates, further reduces generation of heat by reducing electrical current between adjacent particles, called eddy currents. Historically, the concentrator materials of the third type are formed by compressing the concentrator materials at very high pressures. Disadvantageously, high pressure compression damages the insulating layers that coat the particles such that many of the particles electrically connect, causing an increase in eddy currents and heat generation. Further, the high pressures cause deformation of the iron particles, causing the particles to become internally stressed, which undesirably results in reduced magnetic permeability and increased hysteresis losses. It is also noted that the use of high forming pressures requires forming dies and a press, adding significant cost, particularly in applications requiring a custom fit or on-site modifications.

Consequently, a need still exists for improved magnetic flux concentrators and of techniques for fabrication which will overcome the problems associated with the prior art types of concentrators and processes for manufacturing same, as described above. In addition, I have discovered that the effectiveness of a formable magnetic flux concentrator material can be substantially increased if the air and voids can be substantially removed from the formable concentrator material without adversely deforming the iron particles, for the reasons noted above.

SUMMARY OF THE INVENTION

In one aspect of the present invention, the magnetic flux concentrator is a composition comprising a ferromagnetic material in a percent by weight range of from about 65% to 90% and a binder in a percent by weight range of from about 35% to 10%. The binder may a mixture of an epoxy and one or more catalysts. Or, the binder may be one which will harden without the presence of a catalyst when heated to between about 380° F. to 400° F. The concentrator is provided in a formable state as a putty-like body which may be worked into any desired shape dictated by the particular application.

Also, in another aspect of the present invention, a method of making a concentrator material includes steps of preparing a body in a formable putty-like state by mixing a ferromagnetic material and a binder, and then shaping the body while in the formable putty-like state into the desired shape. After the desired shaping of the body is completed, the method further includes the step of solidifying the body by applying heat to activate the catalyst of the binder to change the formable body to a solid body having the desired shape. Catalysts may be used in the binder which will start to react at different temperatures.

In yet another aspect, a method includes providing a formable composite magnetic flux concentrator material including ferromagnetic particles and binder material, and increasing the density of the concentrator material by degassing the concentrator material and by removing voids therein by one of placing the concentrator material in a vacuum and compressively vibrating the concentrator material.

In a preferred embodiment, the concentrator material is both placed in a vacuum and compressively vibrated. In yet another aspect, a method includes providing first and second sources of ferromagnetic powders, the first source having non-spherical shaped particles and the second source having spherical shaped particles, and mixing amounts of one of the first and second sources into a predetermined volume of the other of the sources until the predetermined volume is at a maximum density. The method further includes mixing a binder into the mixture of the first and second sources to form a concentrator material, and forming the concentrator material into a desired shape with low pressure to avoid damaging the insulation on the ferromagnetic material or stressing the ferromagnetic material to thus avoid loss of desirable magnetic properties.

In still another aspect, a formable composite magnetic flux concentrator comprises a composition of a ferromagnetic material in a percent by weight of at least 65%, and a binder in a percent by weight of less than 35%. The ferromagnetic material includes at least two types of particles, one type being non-spherical shaped, and another type being spherical shaped.

These and other features and advantages of the present invention will become apparent to those skilled in the art upon a reading of the following detailed description wherein there is described illustrative embodiments of the invention.

DETAILED DESCRIPTION OF PREFERRED EMBODIMENT

Figure 1:
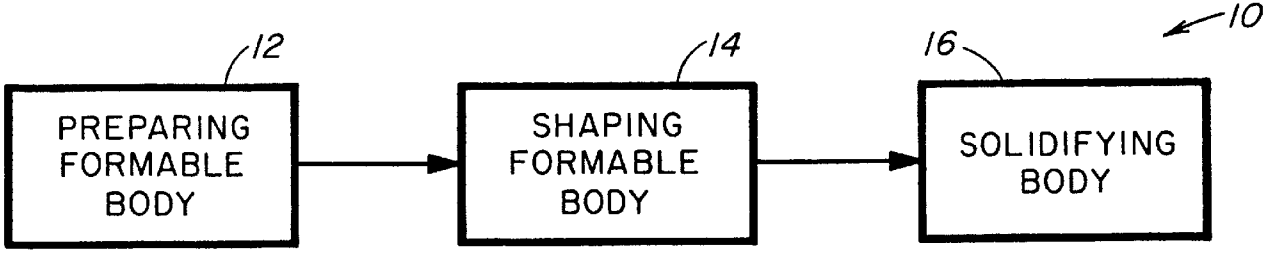
FIG. 1 is a general flow diagram of a method for making a putty-like formable composite magnetic flux concentrator in accordance with the present invention.

Referring to the drawings, and more particularly to FIG. 1, there is illustrated a general flow diagram 10 of the method of making a formable composite magnetic flux concentrator of the present invention. The method includes the basic steps of, initially, preparing a body in a formable putty-like state, as per block 12, by mixing together a ferromagnetic material and a binder and, next, shaping the body, as per block 14, while in the formable putty-like state into a selected shape. The formable putty-like state of the body permits the body to be worked by hand or otherwise into any desired selected shape as dictated by the configuration of an induction heating coil being used in a particular application. In a final basic step of the method, the body is solidified, as per block 16, by applying heat thereto to activate a catalyst of the binder to change the formable body having the selected shape to a solid body.

The ferromagnetic material incorporated in the composition of the concentrator is provided in a percent by weight range of from about 65% to 90% and the binder incorporated in the composition of the concentrator is provided in a percent by weight range of from about 35% to 10%. In a preferred composition suitable for use at low frequencies of from about 60 Hz to about 20 KHz, a level of about 90% by weight of ferromagnetic material and 10% by weight of binder can be employed. In a preferred composition suitable for use at higher radio frequencies of from about 50 KHz to about 500 KHz, a level of about 87% by weight of ferromagnetic material and 13% by weight of binder material can be employed.

The binder may be a mixture of a high viscosity, sticky epoxy and one or more nonactive catalysts. The catalysts are employed to react with and activate the epoxy upon the application of heat to the body in a subsequent step in which the formable body is hardened to a permanent solid body. Preferably, two catalysts can be used in the binder which will start to react at different temperatures. The reason for using more than one temperature catalyst is to start to react the epoxy at a low temperature because as the epoxy is heated it decreases in viscosity. The low temperature catalyst starts to harden the thinning epoxy as it is heated in the oven. Then, the second higher temperature catalyst which is stronger than the first catalyst completes the reaction of the epoxy at a higher temperature.

Alternatively, the binder may be a material, such as a heat curable maleimide type resin, which will harden without the presence of a catalyst when heated to elevated temperatures, such as between about 380° F. to 400° F.

The ferromagnetic material employed in the composition of the magnetic flux concentrator of the present invention is preferably a combination of phosphor insulated high purity annealed iron powders, although various iron powders can be used. Specifically, the preferred ferromagnetic material includes iron powder having particles of a first diameter size and a disc-like shape, and a second diameter size smaller than the first size and having a spherical shape. It is noted that particles having a third size and shape can also be added if desired. By way of example, the following particular iron powders have been used: an electrolytic iron powder having non-spherical, irregular crystalline particles with generally flat sides forming generally right angles (e.g. part no. L-908 and part no. A-251, purchased from SCM Metal Products, Inc., Research Triangle Park, N.C.), and a carbonyl iron powder having spherical-shaped particles (e.g. part no. Fe S-1292, purchased from ISP Technologies, Bound Brook, N.J.). For lower frequency applications, larger iron particles are used (i.e. more L-908 material, which has a larger particle size than the A-251 material). For higher frequency applications, more smaller iron particles are used. It is noted that the L-908 material has a particle size of about 20 um average, the A-251 material has a particle size of about 15 um average, and the S-1292 material has a particle size of about 5 um average.

The preferred materials have a total carbon content of less than about 0.01% and a hydrogen loss of less than about 0.30%. In a preferred embodiment, the loose iron powder employed in the composition of the concentrator of the present invention has an apparent density of greater than about 2.00 grams per cubic centimeter. Preferred materials possess the range of about 100 mesh, with less than about 3% having a particle size (tyler) of greater than 100 mesh. To this material, smaller spherical particles are added, such smaller particles being in the size range of 2 to 10 um and preferably about 5 um. The addition of the smaller diameter particles permits a higher density composition to be achieved without the need to compress at high pressure.

The way to determine how much smaller diameter particles can be suspended in the larger particles is as follows. A known weight of the larger diameter particles is placed in a graduated cylinder. Then smaller particles are added and mixed within the graduated cylinder with the larger particles without increasing the volume of the material in the cylinder. At some point the volume will increase with the addition of more of the smaller particles. At that point the maximum amount of smaller particles that can be suspended or displaced in the larger particles is reached. By weighing the two powder mixture and subtracting the weight of the starting larger particle powder, the weight of the smaller particle powder and thereby the ratio of the larger to smaller powders can be determined. Further, this process can be repeated for the next smaller size particle powder.

Another important property of the iron powder employed in the composition is the particular shape. High purity annealed electrolytically produced iron powders described above can be characterized as being predominately non-spherical, disc-shaped materials. Carbonyl iron powder is made of spherical particles. The combination of shapes produces the following important advantage. The combination of shapes allows the use of much higher ratios of ferromagnetic material to binder material than other iron materials frequently employed, such as only carbonyl iron powders or only electrolytic iron powders. Other materials may be optionally employed in the composition of the concentrator. For example, an insulating material may be employed, to eliminate eddy current flow between the adjacent particles. In general, the insulating material includes acid phosphates; phosphoric acid is particularly preferred as an insulating material and is present in an amount of from about 0.1% to about 1% by weight based on the total composition.

The epoxy of the binder is a polymeric resin or mixture of resins. Typical of the preferred resins are the resins of the nylon, fluorocarbons, epoxy and hot melt adhesive types or classes. These are generally characterized by their ability to provide a formable putty and particle-to-particle insulation after forming. The binder is used to hold the iron particles together and to form a putty both before and after forming and hardening.

After the putty-like body is formed, powders of insulated iron particles of different sizes and shapes can be added to form a skin thereon that will decrease the slight tacky surface on the outside of the unhardened putty. The powders will improve the magnetic conductivity by decreasing the distance between each particle. The outside of the unhardened putty could also be coated with dry powdered paint.

As mentioned above, after the desired shaping of the body is complete and after placing the body on the induction heating coil and further after adding a shell on the body and testing the body, the final basic step of the method takes place, which is, solidifying the body by applying heat to activate the catalyst or catalysts of the binder to change the formable body to the solid body. The catalysts are employed to react with and activate the epoxy, upon the application of heat to the formable body, and thereby hardened to a permanent solid body.

Figure 2:
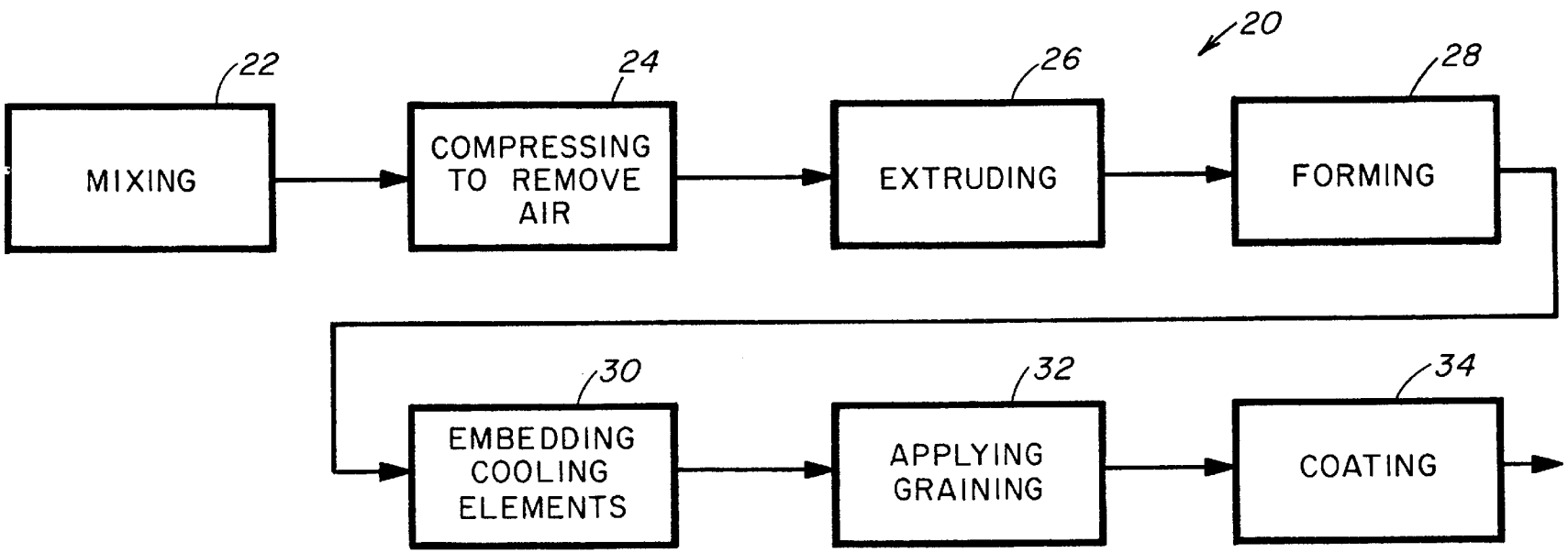
FIG. 2 is a detailed flow diagram of the method for making the magnetic flux concentrator.

Referring to FIG. 2, there is illustrated a more detailed flow diagram 20 of the method of making a formable composite magnetic flux concentrator of the present invention. The above described step of preparing the formable putty-like body can be carried out by, first, mixing or blending the ferromagnetic material and polymer binder together, as per block 22; next, compressing the mixture, such as in a tube, in a vacuum chamber to remove air from the mixture, as per block 24; and then extruding the mixture, as per block 26, to provide the formable body.

The above described step of shaping the formable body while in the formable putty-like state into the desired selected shape can be carried out by, first, working, shaping or forming the body, as per block 28, by hand into the desired shape or by placing the body in a cavity of the required shape and molding or forming the body into the desired shape. Any geometric shape, for example square, rectangular, torroidal, circular, etc., can be achieved that is required to concentrate the magnetic flux field to the appropriate situs on the work piece. Also, the shape can be selected to direct, redirect or block the field.

Next, if desired, the body can be embedded, as per block 30, with hollow elements, such as hose or tubing while the body is in formable putty-like state to provide a means by which the concentrator can be cooled during use. Cooling by passing air, a gas, water or liquid coolant through the tubing may be needed to remove radiant energy generated by the high temperature condition of the work part.

Following next, the shaping step includes "graining" the body, as per block 32, while in the formable putty-like state by applying a magnetic field thereto in the direction of the proposed end use of the concentrator. This will align the particles and displace the binder such that the concentrator material will exhibit improved magnetic characteristics. Testing can be performed after the graining step or after the next described step of coating to ensure that adequate magnetic properties have been obtained.

In order to hold the desired selected shape of the body during the final step of solidifying the body, the shaping step may also include the step of applying a coating material, such as a mixture of plaster of paris and water, to the body, as per block 34, such as by painting it on the body and by allowing it to dry, to form a dry rigid shell thereof about the exterior of the body. Plaster of paris uses the water molecules to form a bond. When heated above 212° F., this bond is eliminated and the dry plaster of paris can easily be removed. A wetting agent may be applied before the coating material in order to assist in uniformly applying the coating material. Also, a dry colored powder may be added to the coating material to indicate a formulation assigned to the concentrator. It should be understood that the graining step can either precede or follow the coating step.

As an alternative to the performance of the coating step, a fumed silica may be added to the ferromagnetic material and binder to assist the formed body in holding its shape during the subsequent solidifying step. The amount of fumed silica added is preferably within the range of from about 0.01 (trace) to 6% by weight of the total composition of the concentrator body.

The above described step of solidifying the body includes applying heat to the body to activate the catalysts of the binder to change the formable body having the selected shape to a solid body. Preferably, two catalysts are used in the binder which start to react at different temperatures. For example, the putty-like body will start to harden upon reaction of the first catalyst at a lower temperature, such as 180° F. The shape of the body is thereby held at this lower temperature and completely converts to the solid body upon reaction of the second catalyst at a higher temperature, such as 300° F. The solidifying step can be carried out with the formable body applied to the induction heating coil such that the heat is applied to both the coil and body.

It also is apparent that this formulation or material could be used in applications other than induction heating where formable high frequency magnetic conductive material is required or needed.

MODIFICATIONS

Figure 3:
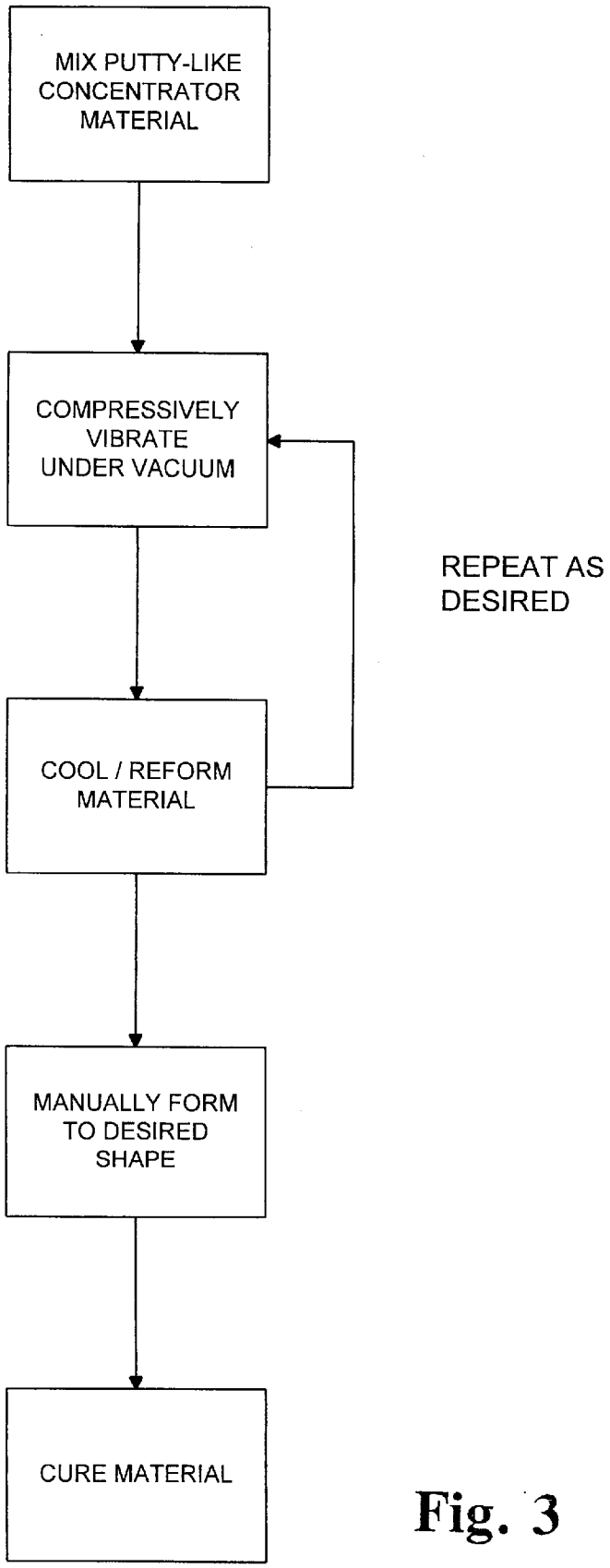
FIG. 3 is a flow diagram of a method for increasing the density of the magnetic flux concentrator.

I have discovered that an improved formable composite magnetic flux concentrator material can be enhanced by maximizing the density of the aforementioned putty-like concentrator material by compressively vibrating the material while under vacuum to de-air the concentrator material and to reduce voids therein (FIG. 3). The method causes the density of the concentrator material to increase by about 5% to 8%, causing an improvement in magnetic flux concentration permeability of about 30% from about 20 to about 27. In particular, the air/void content is reduced from about 5% to less than about 1%, and the density is increased from about 4.38 grams/cc to about 4.70 grams/cc. The method of compressively vibrating the concentrator material under vacuum causes the increase in density substantially without undesirable deformation and/or work hardening of the iron particles, without the undesirable reduction in permeability and increase in hysteresis associated with methods using high pressure forming techniques, and substantially without damage to the insulation on the outside of the particles so that eddy currents do not increase and cause heat generation problems.

A formable composite magnetic flux concentrator material as described above is placed in a pipe inside a vacuum chamber. The pipe has a closed end and a plunger closing the other end. A vacuum of at least about 10 inches Hg, and preferably 29 inches Hg or 25 microns, is drawn in the chamber for about 2 minutes. This causes the concentrator material to swell as air in the material expands. An air hammer positioned outside of the vacuum chamber is operably connected to the plunger forming an end of the pipe by a rod and sleeve arrangement. It is contemplated that various air hammers can be used, however the particular air hammer that I used has a reciprocatable slideable mass of 1 pound having a stroke of about 2.25 inches to 4 inches, and operates at a frequency of about 1200 to 4000 cycles per minute. The lower end of this range of impact energy transfer is calculated to be: (1 lb)(2.25 inches)(1200 cycles/minute)(1 ft/12 inches)=225 ft.lb./minute of energy transfer. While the vacuum continues to be held, the air hammer is operated for about 2 minutes until the effectiveness of degassing from the vibration is reduced. The putty-like concentrator material is then extruded from the pipe and re-rolled to a smaller diameter than the chamber/pipe inside diameter. Thereafter, the concentrator material is again placed in the pipe and in the chamber. A vacuum of about 29 inches Hg or 25 microns is again drawn. After about two minutes, the air hammer is again actuated to compress the concentrator material. The concentrator material is again removed from the pipe and cooled. The procedure can be repeated if desired, however two iterations is normally sufficient. Thereafter, the de-aired, "void reduced" putty-like concentrator material is then packaged for shipment in a moisture resistance material such as cling wrap material. Notably, the "void reduced" putty-like concentrator material can be grained, as discussed above, to improve its permeability.

In another form, the density of the composite concentrator material is mixed in a high shear mixer while under a vacuum, such as in a Ross planetary mixer. The material can be heated or preheated if desired, but the heat generated by mixing is generally sufficient for mixing. The resultant concentrator material is relatively dense such that compressive vibration to increase density may not be required. However, compressed vibration can be used to further increase the density, as discussed above.

In still another form, the concentrator material is compressively vibrated under vacuum and then cured while still under compression and/or vacuum. This can eliminate one of the vacuum/vibration steps noted above while still achieving a desired increase in density in the concentrator material. Under this aspect, the concentrator material must be compressed into the desired final shape when it is heated to cure the epoxy. Advantageously, the compressive vibrations assists in forming the material.

In still another form, the concentrator material can be made with an epoxy and with iron particles that are machineable, so that it can be machined to a final shape after it is cured. The machineable composite concentrator material is optimally made from machineable type iron powders mixed with about 4% to 15% binder, although it is contemplated that various percentages can be used. Machineable carbonyl iron particles are made, for example, by Polymer Corporation of Reading, Pennsylvania under the name Ferrotron. It is contemplated that the concentrator material made from 85% iron powder can be formed at about 10 tons per square inch (or less) without undesirably deforming the iron particles or undesirably damaging the insulation of the iron particles. As the percent of iron particles approaches 96%, the material may need to be compressively vibrated to assist in forming the concentrator material to avoid undesirable deformation to the iron particles or damage to the insulation. The optimal forming parameters can be determined for particular "recipes" of concentrator materials by testing.

In yet another form, an iron alloy such a ferrous alloy including 48% nickel is substituted one or both of the high purity iron particles. A nickel ferrous alloy is advantageous in that it has an initial permeability of about 14,000 to 65,000 and a saturation of about 10,000 while solid iron has an initial permeability of about 45,000 and a saturation of about 21,000. Thus, by choosing a particular alloy, the permeability and saturation of the composite magnetic flux concentrator material can be selectively adjusted to a desired level. The ferrous alloy can be phosphor coated, painted, coated with an oxidized coat by acid treatment or otherwise covered by an insulating material to prevent or minimize eddy currents between particles in the composition.

Notably, as the percentage of the iron particles in the concentrator composite material is increased from 65% to 85% to 96% and above, the viscosity of the composite concentrator material is increased, making the material stiff and more difficult to form. Nonetheless, it remains important to form the concentrator materials at pressures low enough to prevent damage to insulation on the particles and to prevent undesirable deformation of the particles resulting in internal stress. Depending on the ingredients in the above noted concentrator materials and the percentages used, pressures as high as about 10 tons per square inch can be used in many above noted materials without undesirably deforming the iron particles or damaging their insulation. Notably, compressive vibration can be used to help form the material to reduce damage to the iron particles or their insulation. The above noted processes of 1) using "void reduced" material (by compressive vibration, by vacuum assisted compression, by mixing under vacuum), 2) using high density material (by two iron particle sizes, by two iron particle shapes), 3) using grained material, using alloy material and 4) using machineable material, all contribute to the ability to produce a concentrator formable at low pressure having valuable and effective magnetic flux properties (i.e. high permeability, low hysteresis, low eddy currents and low heat generation).

The present invention and its advantages will be understood from the foregoing description and it will be apparent to persons of ordinary skill in the art that various changes may be made thereto without departing from its spirit and scope of the invention and/or without sacrificing its material advantages, the form previously described herein being merely preferred or exemplary embodiments thereof.

The embodiments of the invention in which an exclusive property or privilege is claimed are defined as follows:

1. A method of making a formable composite magnetic flux concentrator, comprising the steps of:

(a) preparing a body in a formable putty-like state by mixing together a ferromagnetic material and a binder, said ferromagnetic material being in a percent by weight in the range of about 65% to 90% and said binder being in a percent by weight range of about 35% to 10%;

(b) shaping said body while in said formable putty-like state into a selected shape; and (c) solidifying said formable body by applying heat to said body to cause said binder to change said formable body having the selected shape to a solid body.

2. The method of claim 1 wherein said binder is a mixture of an epoxy and at least two catalysts.

3. The method of claim 2 wherein said shaping includes applying a coating material to the body to form a dry shell thereof about the exterior of the body so that the body will hold said selected shape.

4. The method of claim 1 wherein said shaping includes adding a dry colored powder to the coating material to indicate a formulation assigned to the concentrator.

5. The method of claim 1 wherein said preparing includes adding a fumed silica to the ferromagnetic material and binder.

6. The method of claim 5 wherein the fumed silica is within the range of from about 0.01% to 6% by weight of the total composition of the concentrator body.

7. The method of claim 1 wherein said shaping includes embedding hollow elements in the body while the body is in said formable putty-like state to provide a means by which the concentrator can be cooled during use.

8. The method of claim 1 wherein said shaping includes graining the body while the body is in said formable putty-like state by applying a magnetic field to the body in the direction of the proposed end use of the concentrator.

9. The method of claim 1 wherein said ferromagnetic material is an iron powder having particles of a first shape and a second shape different than said first shape.

10. The method of claim 1 wherein said binder will harden without the presence of a catalyst when heated to between about 380° F. to 400° F.

11. A method comprising steps of:

providing a formable magnetic flux concentrator material;

forming the concentrator material at low pressure so that there is no loss of desirable magnetic properties; and baking the formable concentrator material to harden the concentrator material into a permanent shape.

12. A method as defined in claim 11 wherein said step of forming includes forming the material at less than 10 tons per square inch.

13. A method as defined in claim 12 wherein said step of forming includes forming the material by hand.

14. A method as defined in claim 11 including a step of machining the concentrator material after the step of baking.

15. A method as defined in claim 14 wherein the concentrator material includes about 85% to 96% ferromagnetic material.

16. A method as defined in claim 11 wherein the step of forming includes compressively vibrating the concentrator material.

17. A method comprising steps of:

mixing a formable magnetic flux concentrator material including at least about 85% machineable iron powder;

forming the concentrator material at less than 10 tons per square inch;

machining the formed concentrator material after the step of forming; and hardening the formed composite material.

18. A method as defined in claim 17 wherein the step of forming includes compressively vibrating the concentrator material.

19. A method as defined in claim 17 wherein the step of mixing includes at least about 96% machineable iron powder.

20. A method for forming a magnetic flux concentrator comprising steps of:

selecting particles of predetermined size comprising an alloy having a selected permeability;

mixing a formable magnetic composite material including the alloy particles;

forming the formable magnetic composite material at a pressure below about 10 tons per square inch and which is low enough to prevent undesired loss of magnetic properties below the selected permeability; and hardening the formed material.

21. A method as defined in claim 20 wherein the step of mixing includes mixing another magnetically conductive material with the alloy particles, the another magnetically conductive material having a different composition than the alloy particles.

* * * * *